US006016860A

United States Patent [19]

Shaw et al.

[11] Patent Number: 6,016,860

[45] Date of Patent: Jan. 25, 2000

[54] BONDING TWO CORRUGATED MEDIUMS AT FLUTE TIPS ENSURING ACCURATE ALIGNMENT

[75] Inventors: Neil William Shaw, Sassafras; Frederick John Mutimer, Lower Plenty, both of Australia

[73] Assignee: Amcor Limited, South Melbourne, Australia

[21] Appl. No.: 08/973,773

[22] PCT Filed: Jun. 18, 1996

[86] PCT No.: PCT/AU96/00361

§ 371 Date: Dec. 19, 1997

§ 102(e) Date: Dec. 19, 1997

[87] PCT Pub. No.: WO97/00709

PCT Pub. Date: Jan. 9, 1997

[30] Foreign Application Priority Data

Jun. 20, 1995 [AU] Australia ..... PN3670

[51] Int. Cl.[7] ..... B31F 1/28

[52] U.S. Cl. ..... 156/351; 156/472; 156/470; 156/471; 156/350; 156/361

[58] Field of Search ..... 156/205, 210, 156/470, 471, 472; 388/912; 318/41, 27

[56] References Cited

U.S. PATENT DOCUMENTS

| | | | |
|---|---|---|---|
| Re. 33,500 | 12/1990 | Bisseling | 388/912 |
| 1,184,748 | 5/1916 | Hicks | 318/41 |
| 3,700,518 | 10/1972 | Ohmori . | |
| 4,174,237 | 11/1979 | Hemming, Jr. et al. . | |
| 4,503,376 | 3/1985 | Okuyama | 318/802 |
| 4,527,788 | 7/1985 | Masuda | 270/21.1 |
| 4,614,099 | 9/1986 | Coulter | 72/29.1 |
| 4,806,183 | 2/1989 | Williams . | |
| 4,886,563 | 12/1989 | Bennett et al. | 156/205 |
| 5,263,413 | 11/1993 | Ikeguchi | 101/183 |
| 5,434,486 | 7/1995 | Tanaka | 318/69 |
| 5,530,323 | 6/1996 | Breitzmann | 156/205 |
| 5,674,349 | 10/1997 | McKinlay et al. . | |

FOREIGN PATENT DOCUMENTS

| | | |
|---|---|---|
| 62323/86 | 4/1987 | Australia . |
| 11926/88 | 8/1988 | Australia . |
| 26961/88 | 6/1989 | Australia . |
| 78741/91 | 12/1991 | Australia . |
| WO 89/09127 | 10/1989 | WIPO . |
| WO 93/03913 | 3/1993 | WIPO . |
| WO 93/05957 | 4/1993 | WIPO . |

*Primary Examiner*—Michael W. Ball
*Assistant Examiner*—Barbara J. Musser
*Attorney, Agent, or Firm*—Alston & Bird LLP

[57] ABSTRACT

This invention relates to improved apparatus for forming paper board structures in which two corrugated mediums are bonded together at their flute tips. The apparatus comprises: two register rolls for ensuring that the mediums are brought into precise flute tip to flute tip alignment for bonding; dependent electric motors to drive the register rolls in which one roll is driven by a reference motor and the second register roll is driven by a follower motor; location sensing devices associated with each register roll to measure a value related to the location of a position on the periphery of each register roll; control means which compares the measured values for each register roll and if necessary adjusts the voltage or current of the follower motor to maintain alignment of the flute tips of the two mediums.

14 Claims, 2 Drawing Sheets

BONDING TWO CORRUGATED MEDIUMS AT FLUTE TIPS ENSURING ACCURATE ALIGNMENT

FIELD OF THE INVENTION

This invention relates to improved methods and apparatus for forming paper board structures in which two corrugated mediums are bonded together at their flute tips. A structure of this kind is disclosed in Australian patent 567833 which is incorporated herein by reference.

BACKGROUND OF THE INVENTION

One apparatus for forming such corrugated board is disclosed in Australian patent 609089 [incorporated herein by reference]. Variations on this apparatus and method are disclosed in Australian patents 615053,618977, 653431 and 655076. All of these inventions follow the steps of corrugating the two mediums, bringing them into tip to tip registration, bonding them together, and then applying a liner to one or both mediums.

An alternative method is disclosed in U.S. Pat. No. 3,700,518 in which the two corrugated mediums are bonded to the liners first and then brought into tip to tip registration and bonded together.

One of the difficulties of forming paperboard structures wherein two corrugated mediums are adequately bonded together at their flute tips, is accurately aligning the peaks of the flutes along the entire length of the mediums. It will be appreciated that this is even more difficult to achieve at the web speeds of commercially used corrugating machines.

Australian patent 655076 provides a mechanical way of controlling alignment by using one driving motor for both rolls and sets of end gears at each end of the rolls. In practice this arrangement depends on the accuracy of the gearing and the initial alignment of the rolls at the beginning of each production run.

Electrical control of operations in conventional paper corrugating machines has been proposed in U.S. Pat. No. 4,174,237 to adjust the speed of single facer units to the needs of the double backer unit and in U.S. Pat. No. 4,806,183 to modify the speed of adhesive applicators to match those of the webs to which the adhesive is to be applied.

Australian patent 664018 attempted to solve the problem of flute tip to flute tip alignment in non conventional paper board by providing flute count resolvers to enable the speed of drive motors for each corrugating roll to be electronically controlled. The flute count resolvers count the number of flutes per unit time for each roll and by comparing the result the difference can be used to correct the speed of one of the two independent motors. This solution has not been used because it is difficult to precisely control the speeds of independent motors. Also the timing of the speed of the flute tips is a method with a relatively low degree of accuracy. As with other analogue devices this timing arrangement is incapable of providing the precision required to achieve precise tip to tip alignment at the speeds of commercially operated corrugating machines.

BRIEF DESCRIPTION OF THE INVENTION

It is an object of this invention to provide an alternative and more cost effective means of maintaining alignment of the flutes at commercial production speeds in producing paper board structures in accordance with the method of Australian patent 567833 or U.S. Pat. No. 3,700,518.

To this end the present invention provides an improvement in a corrugated board making apparatus of the kind which produces board having two corrugated mediums bonded together at their flute tips which includes two corrugated register rolls driven by separate motors, the improvement comprising means to measure values related to the location of a position on the periphery of the register rolls and a control means which compares the values for each register roll and if necessary adjusts the voltage or current of one motor to adjust the speed of one register roll to maintain flute tip to flute tip alignment of said corrugated mediums.

To enable the speed of the motors to be adjusted to achieve quick rematching of angular positions the electric drive motors of the register rolls operate dependently. This means the adjustment of the speed of the follower motor can be achieved more precisely. Either DC or AC vector motors can be used as the electric drive motors. In order to minimise the effects of torsional loads which can cause misalignment of the flutes, the electric motors are rigidly coupled to the register rolls and preferably each share a common drive shaft or trunnion with its associated register roll. The motor rotors and roll diameters of the register rolls are similarly sized to provide a rigid coupling. In order to minimise torsional deflection and the associated lateral forces in the tip to tip bonding area, low RPM, high torque motors are preferred. To avoid interference of stator components in the drive motors they are preferably mounted on opposite sides of the two register rolls. These features of the drive system are important in ensuring that the tolerance range for alignment of the flute tips is narrow.

It is important to note that merely controlling the speed of the register rolls does not guarantee the alignment of flute tips. It is possible for disturbances to occur which cause flute misalignment despite the speeds of the two rolls being matched.

The values which relate to a location of a position on the periphery of the rolls can be measured in many different ways. It is preferred to measure the angular position of each register roll and then directly compare these values or values relating to the phase relationship of the angular position measurements.

Preferably the measurement of the angular position of the of the register rolls is accomplished by resolvers rigidly coupled to the shafts of the electric motors. In order to achieve the degree of alignment required the number of pulses per revolution needs to be greater than 40000 and preferably at least 80000. In matching the angular positions the tolerance must be no more than one pulse per revolution. This means that the greatest misalignment will be one in 80,000, which for a conventional corrugated roll would be a misalignment of no more than 14 microns. By coupling the drive motors rigidly to the register rolls torsional loads will not amplify the tolerance range to any significant degree. The significance of the misalignment depends on the diameter of the roll and the pitch of the flutes in the corrugating medium.

A microprocessor is provided to undertake a comparison of the digital pulses in order to determine exactly the phase relationship or the relative positions of the two register rolls. By using one drive motor as a reference motor and adjusting the current or voltage of the second motor in response to variations in the phase relationship or the relative positions of the two register rolls to a higher degree of accuracy at high machine speed than is possible with previously proposed machines.

DETAILED DESCRIPTION OF THE INVENTION

Figure 1:
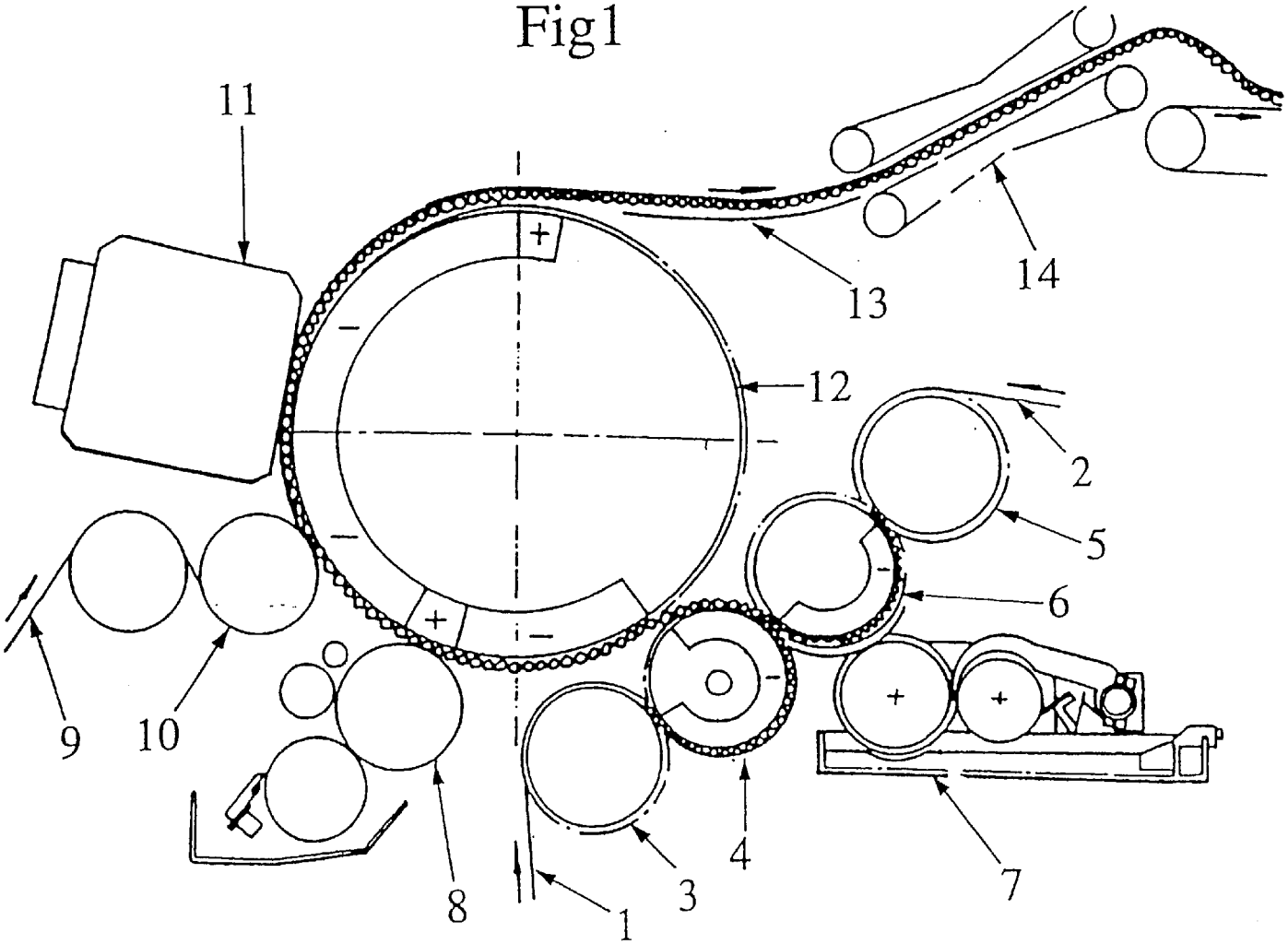
Figure 2:
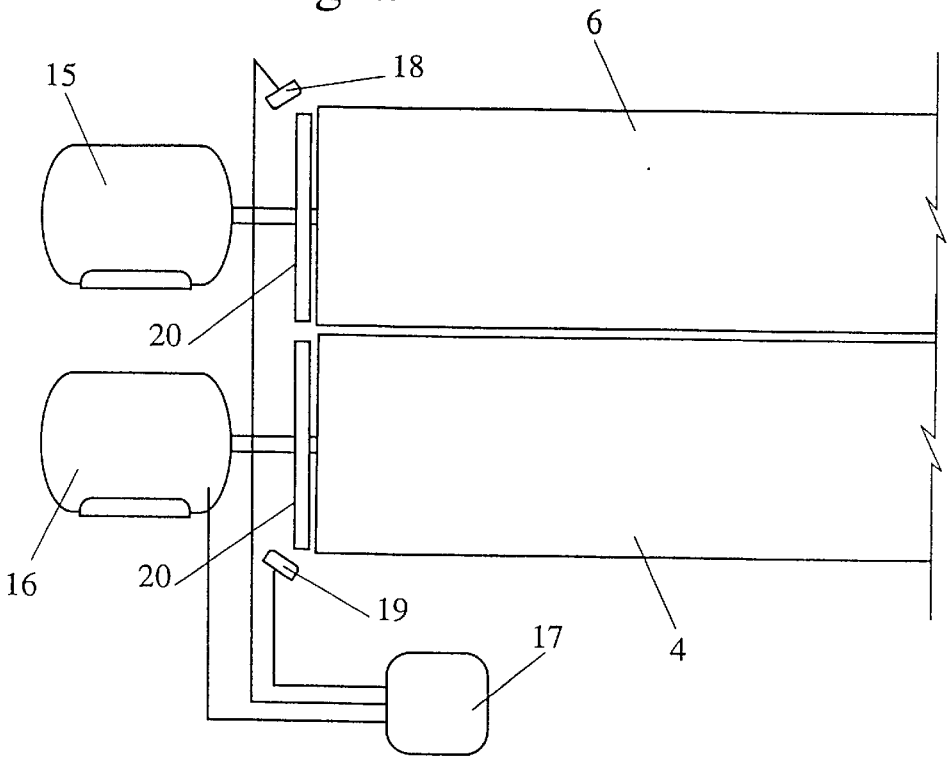
Figure 3:
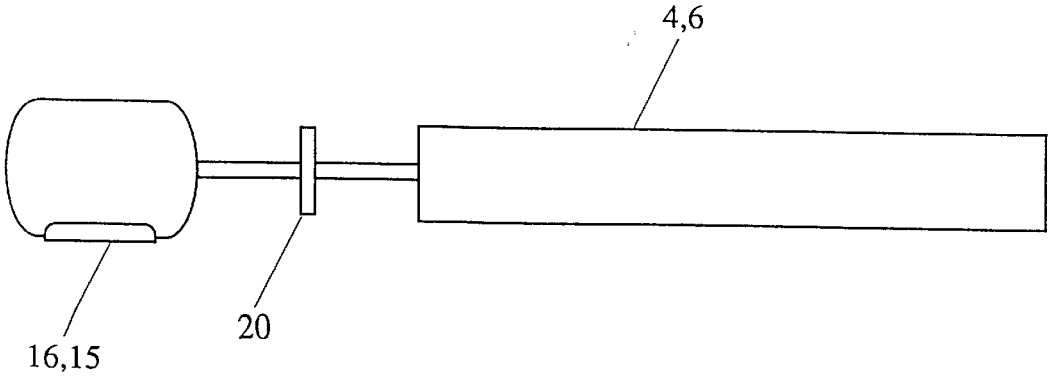

A preferred embodiment of the invention is illustrated in the drawings in which:

FIG. 1 shows a schematic view of a single facer unit of the kind disclosed in Australian patent 609089, FIG. 2 is a schematic view of an arrangement which provides precise tip to tip flute alignment, FIG. 3 is a schematic view of an arrangement for generating pulses using a resolver.

FIG. 1 illustrates a single facer unit of the kind described in patent 609089. The corrugating medium 1 and 2, maintained on mill roll stands [not shown] and optionally passed over a preheater [not shown] is fed onto rolls 3 and 5 of the two pairs of corrugating rolls 3 & 4 and 5 & 6. The mediums 1 and 2 are corrugated and then adhesive is applied to medium 1 at adhesive station 7. The corrugated mediums 1 and 2 are then joined together flute tip to flute tip between the non meshing corrugated rolls 4 and 6. The combined mediums are fed onto a carrier roll 12 and glue is applied to the exposed flute tips at the adhesive station and a liner 9 is subsequently bonded to the combined mediums with the aid of the heater 11. After passing the heater 11 the carrier roll 12 transports the combined mediums and liner to an inclined transport conveyor 14 for discharge to the corrugator bridge.

In accordance with known variations of this apparatus the carrier roll 12 can be replaced with a toothed conveyor belt. Also the method of U.S. Pat. No. 3,700,518 can be used eg in the modified form disclosed in Australian patent 664018.

FIG. 2 illustrates an embodiment of the present invention where the corrugating rolls 4 and 6 which are the register rolls between which the corrugated mediums are bonded flute tip to flute tip, are driven by separate motors 15 and 16. [In patent 664018 the register rolls for the method of U.S. Pat. No. 3,700,518 are rolls 19 and 20.] These motors are typically DC or AC vector electric motors rigidly coupled to the corrugated rolls 4 and 6. Preferably the motor rotor is an extension of the roll body of its associated register roll. The motor frames may be fixed to the machine frame on opposite sides [not as shown]. The steam and condensate connections for heating each of the rolls 4 and 6 are made to the respective non drive sides of rolls 4 and 6. The motor 15 driving roll 6 is the reference motor. Its speed is initially set by an operator and is not altered during operation of the apparatus. Motor 16 driving the second roll 16 is the follower motor.

Flute synchronisation of the corrugated rolls 4 and 6 is achieved through the use of a microprocessor 17 which is fed values related to the location of a position on the periphery of the two rolls 4 and 6. Microprocessor 17 compares these values and determines whether the two motors 15 and 16 are achieving flute synchronisation of the rolls 4 and 6. If they are not synchronised the microprocessor 17 determines whether the follower motor 16 is lagging or leading and then adjusts the voltage or armature current of the follower motor 16 in order to achieve precise alignment of the two related positions on rolls 4 and 6.

The values fed to the microprocessor 17 related to the location of a position on the periphery of the register rolls 4 and 6 can be determined in a number of conventional ways. The preferred method uses an resolver 20 to generate pulses. FIG. 3 illustrates one arrangement in which the resolvers 20 are placed on the motor shafts of both the reference motor 15 and the follower motor 16 to generate a pulse count for each roll. The pulse count is initiated by a reference pulse from roll 6 which continues for each revolution of roll 6. This information is then sent to the microprocessor 17 which determines whether the two rolls 4 and 6 are in phase within the predetermined tolerance of one pulse. Preferably the microprocessor monitors the pulse sequences per revolution which achieves a tolerance of 1 in 80000 when 80000 digital pulses are generated per revolution of the rolls 4 and 6.

Alternatively other digital sensors such as optical devices may be used to determine the angular position of the rolls 4 and 6. Many other precision methods exist for generating signals related to relative angular positions of rotating elements and then sensing these signals including the use of fibre optics and light speed videos. All these methods can be substituted for the resolver system described above.

The rolls 4 and 6 can be different diameters in which case the rolls rotate at different speeds in terms of revolutions per minute but are synchronised to the same peripheral speed. One method would be to use a pulse multiplication to increase the pulse rate of the larger roll rotating at a lower revolution rate. The multiplication would be the ratio of the smaller to the larger diameter and this would enable comparison of the angular positions with the same degree of accuracy as when rolls of equal diameter are used.

When machine speeds of greater than 150 meters per minute are used it can be seen that the control means of this invention can achieve a higher degree of alignment of the flute tips of the combined corrugated mediums than is practically feasible by other methods. Because the precision flute tip to flute tip bonding has a direct effect on the strength characteristics of corrugated board this invention allows high quality board to be produced at high machine speeds with the consequence of lower unit cost of production for a given board strength.

We claim:

1. Apparatus for forming corrugated paperboard of the kind in which two corrugated mediums are joined at their flute tips without an intervening liner comprising:

two register rolls for ensuring that the mediums are brought into precise flute tip to flute tip alignment for bonding, dependent electric motors to drive the register rolls in which one roll is driven by a reference motor and the second motor register roll is driven by a follower motor, each of said dependent electric motors having a drive motor shaft which is an extension of the roll body for its associated register roll so that precise flute tip to flute tip alignment is maintained, location sensing devices associated with each register roll to measure a value related to the location of a position on the periphery of each register roll, and control means which compares the measured values for each register roll and if necessary adjusts the voltage or current of the follower motor to maintain alignment of the flute tips of the two mediums.

2. Apparatus as claimed in claim 1 in which a resolver located on the roll drive shaft is used in measuring a value related to the position on the periphery of the roll.

3. Apparatus as claimed in claim 2 in which at least 40000 pulses per revolution are generated and the follower motor is maintained within one pulse per revolution of the reference motor.

4. Apparatus as claimed in claim 1 wherein the drive motors are low RPM, high torque DC or AC vector motors.

5. Apparatus as claimed in claim 1 in which the follower motor is mounted on the side of its register roll opposite to the side on which the reference motor is mounted on its register roll.

6. Apparatus as claimed in claim 1 in which the register rolls are corrugating rolls that convey two corrugated mediums between their non meshing surfaces to bring them into tip to tip contact prior to the bonding of a liner to either medium.

7. Apparatus as claimed in claim 1 in which the register rolls are corrugated rolls conveying two single faced corrugated boards into contacting relationship with the flute tips of the corrugated mediums aligned for bonding.

8. Apparatus for forming corrugated paperboard of the kind in which two corrugated mediums are joined at their flute tips without an intervening liner comprising:

two register rolls for ensuring that the mediums are brought into precise flute tip to flute tip alignment for bonding, dependent electric motors to drive the register rolls in which one roll is driven by a reference motor and the second register roll is driven by a follower motor, the dependent electric motors having drive shafts which are rigidly coupled to the respective register rolls and being low RPM, high torque DC or AC vector motors so that precise flute tip to flute tip alignment is maintained, location sensing devices associated with each register roll to measure a value related to the location of a position on the periphery of each register roll, and control means which compares the measured values for each register roll and if necessary adjusts the voltage or current of the follower motor to maintain alignment of the flute tips of the two mediums.

9. Apparatus as claimed in claim 8 in which a resolver located on the roll drive shaft is used in measuring a value related to the position on the periphery of the roll.

10. Apparatus as claimed in claim 9 in which at least 40000 pulses per revolution are generated and the follower motor is maintained within one pulse per revolution of the reference motor.

11. Apparatus as claimed in claim 8 in which each of said dependent electric motors has a drive motor shaft which is an extension of the roll body for its associated register roll.

12. Apparatus as claimed in claim 8 in which the follower motor is mounted on the side of its register roll opposite to the side on which the reference motor is mounted on its register roll.

13. Apparatus as claimed in claim 8 in which the register rolls are corrugating rolls that convey two corrugated mediums between their non meshing surfaces to bring them into tip to tip contact prior to the bonding of a liner to either medium.

14. Apparatus as claimed in claim 8 in which the register rolls are corrugated rolls conveying two single faced corrugated boards into contacting relationship with the flute tips of the corrugated mediums aligned for bonding.

* * * * *